United States Patent [19]

Benford

[11] Patent Number: 4,711,113

[45] Date of Patent: Dec. 8, 1987

[54] APPARATUS FOR REDUCING CORE LOSSES OF GRAIN-ORIENTED SILICON STEEL

[75] Inventor: James G. Benford, Pittsburgh, Pa.

[73] Assignee: Allegheny Ludlum Corporation, Pittsburgh, Pa.

[21] Appl. No.: 873,111

[22] Filed: Jun. 10, 1986

Related U.S. Application Data

[60] Continuation of Ser. No. 714,587, Mar. 21, 1985, abandoned, which is a division of Ser. No. 683,839, Dec. 19, 1984, Pat. No. 4,533,409.

[51] Int. Cl.[4] ..... B21B 15/00; B21B 45/00

[52] U.S. Cl. ..... 72/197; 72/465

[58] Field of Search ..... 72/196, 197, 465, 703, 72/366; 148/111, 120; 83/863, 875

[56] References Cited

U.S. PATENT DOCUMENTS

| | | | |
|---|---|---|---|
| 857,983 | 6/1907 | Cowles | 72/366 |
| 1,313,054 | 8/1919 | Berry | 148/31.5 |
| 2,234,968 | 3/1941 | Hayes et al. | 148/120 |
| 3,335,592 | 8/1967 | Woodling | 72/197 |
| 3,647,575 | 3/1972 | Fiedler et al. | 148/111 |
| 3,869,896 | 3/1975 | Carr et al. | 72/703 |
| 3,947,296 | 3/1976 | Kumazawa | 148/111 |
| 3,990,923 | 11/1976 | Takashina et al. | 148/111 |
| 4,059,000 | 11/1977 | Bodnar | 72/196 |
| 4,203,784 | 5/1980 | Kuroki et al. | 148/111 |
| 4,503,696 | 3/1985 | Roeder | 72/197 |
| 4,548,656 | 10/1985 | Kimoto et al. | 148/111 |

FOREIGN PATENT DOCUMENTS

| | | | |
|---|---|---|---|
| 1540958 | 8/1968 | France | 72/197 |
| 23220 | 10/1969 | Japan | 72/197 |
| 1072925 | 6/1967 | United Kingdom | 72/197 |

*Primary Examiner*—Lowell A. Larson
*Attorney, Agent, or Firm*—Patrick J. Viccaro

[57] ABSTRACT

An apparatus for scribing grain-oriented silicon steel to improve the core loss thereof is provided. The method comprises passing the final gauge steel after cold rolling through a roll pass defined by an anvil roll and a scribing roll having a surface with a plurality of projections thereon with said projections being generally in a direction of the roll axis; the anvil roll is constructed from a material that is relatively more elastic than the material from which said scribing roll is constructed. Preferably the scribing roll is constructed from steel and the anvil roll is constructed from rubber.

2 Claims, 1 Drawing Figure

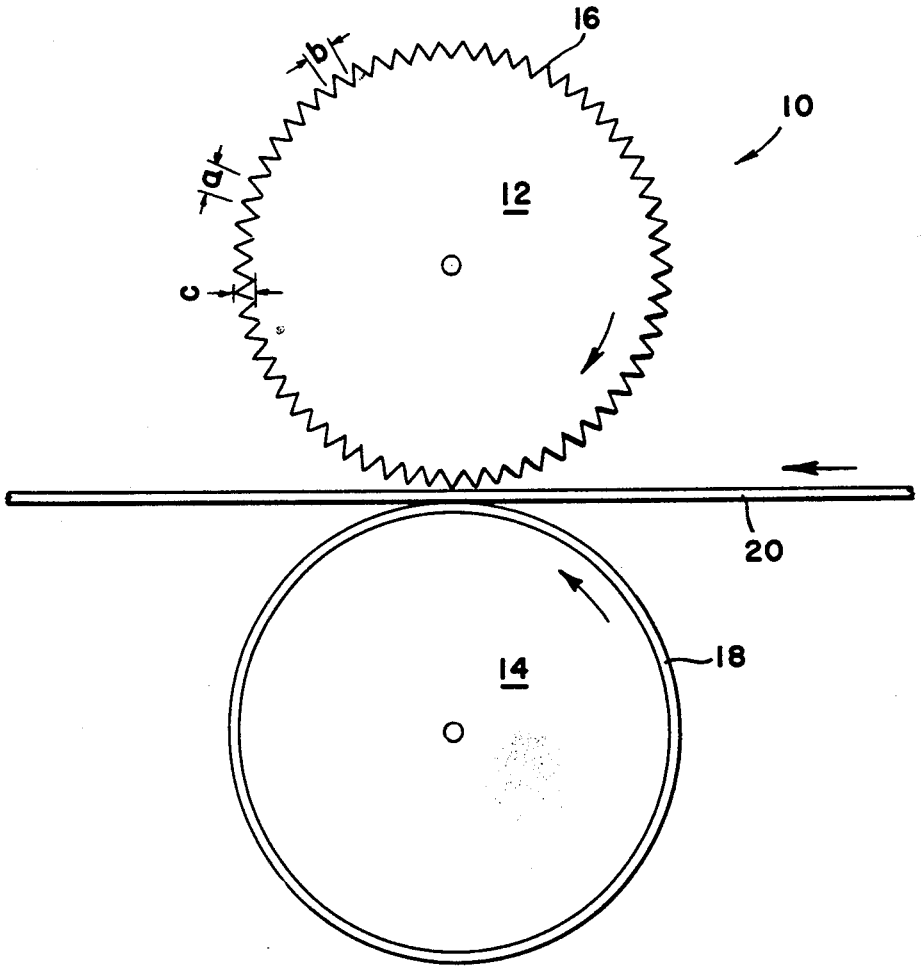
16
b
10
a
12
c
20
14
18

APPARATUS FOR REDUCING CORE LOSSES OF GRAIN-ORIENTED SILICON STEEL

This is a continuation of application Ser. No. 714,587, filed Mar. 21, 1985, now abandoned which is a division of Ser. No. 683,839, filed 12-19-84, now U.S. Pat. No. 4,533,409.

BACKGROUND OF THE INVENTION

This invention relates to an apparatus for working the surface of grain-oriented silicon steel to affect the domain size and reduce core losses. More particularly, this invention relates to providing localized compressive strains on the surface of grain-oriented silicon steel through a roll pass.

Grain-oriented silicon steel is conventionally used in electrical applications, such as power transformers, generators, and the like. Grain-oriented silicon steels of this type typically have silicon contents on the order of 2.8 to 4.5%. The silicon content of the steel in electrical applications, such as transformer cores, permits cyclic variation of the applied magnetic field with limited energy loss, which is termed core loss. It is desirable, therefore, in steels of this type to reduce core loss.

In the production of silicon steels of this type the steel is hot rolled and then cold rolled to final gauge by one or more cold-rolling operations with intermediate anneals. Thereafter the steel is typically decarburized, coated, as with a magnesium oxide coating, and then subjected to a final high temperature texture annealing operation wherein the desired secondary recrystallization is achieved.

It is known that core loss values of grain-oriented silicon steels may be reduced if the steel is subjected to any of various practices to induce localized strains in the surface of the steel. Such practices may be generally referred to as "scribing" and may be performed either prior to or after the final high temperature annealing operation. If the steel is scribed after the decarburization anneal but prior to the final high temperature texture anneal, then the scribing generally controls the growth of the secondary recrystallization grains to preclude formation of large grains and so results in reduced domain sizes. U.S. Pat. No. 3,990,923, issued Nov. 9, 1976, discloses methods wherein prior to the final high temperature annealing, a part of the surface is worked, such as by mechanical plastic working, local thermal treatment or chemical treatment.

If the steel is scribed after final texture annealing, then there is induced a superficial disturbance of the stress state of the texture annealed sheet so that the domain wall spacing is reduced. These disturbances typically are narrow, straight lines or scribes generally spaced at intervals equal to or less than the grain size of the steel. The scribe lines are typically transverse to the rolling direction and typically applied to only one side of the steel. U.S. Pat. No. 3,647,575, issued Mar. 7, 1972, discloses a method wherein watt losses are to be improved in cube-texture silicon-iron sheets after annealing and complete recrystallization. The method includes partially plastically deforming the sheet surface by providing narrowly spaced shallow grooves, such as by a cutter or abrasive powder jet. The sheet is preferably scribed on opposite sides in different orientations. U.S. Pat. No. 4,203,784, issued May 20, 1980, relates to producing a plurality of linear strains to grain-oriented steel having a glassy film after final texture annealing by forcibly moving a rotatable body having a convex roller shape in a transverse direction.

There have also been attempts to use grooved surface rollers during the cold rolling prior to final texture annealing to develop a desired grain orientation. U.S. Pat. No. 3,947,296, issued Mar. 30, 1976, discloses a process to produce cube-on-face grain orientation by cold rolling the hot-rolled band for at least 20% reduction using a roller with a grooved surface, then cold rolling with smooth rollers and thereafter decarburizing and final texture annealing. U.S. Pat. No. 4,318,758, issued Mar. 9, 1982, relates to producing a (hko)[001] texture by cold rolling the hot-roll band, coating and final texture annealing. Such practices are distinguishable from scribing techniques.

What is needed is a method and apparatus for scribing grain-oriented silicon steel wherein the scribe lines required to improve the core loss values of the steel may be applied in a uniform and efficient manner to result in uniform and reproducibly lower core loss values. A low cost scribing practice should be compatible with the conventional steps and equipment for producing grain-oriented silicon steels.

SUMMARY OF THE INVENTION

In accordance with the present invention, a method for improving the core loss of grain-oriented silicon steel after cold rolling to final gauge is provided for scribing the steel by passing it through a roll pass defined by an anvil roll and a scribing roll. The scribing roll has a roll surface with a plurality of projections thereon. The anvil roll is constructed from a material that is relatively more elastic than the material from which the scribing roll is constructed. The steel may be scribed prior to or after final texture annealing.

An apparatus is also provided including the roll set of the anvil and scribing rolls through which the cold-rolled final gauge steel passes.

BRIEF DESCRIPTION OF THE DRAWING

The sole FIGURE illustrates a roll pass apparatus of the present invention.

DETAILED DESCRIPTION OF THE PREFERRED EMBODIMENTS

Broadly, in accordance with the invention, a grain-oriented silicon steel which has been cold rolled to final gauge sheet or strip product 20 is passed through a roll pass or set 10 defined by an anvil roll 14 and a scribing roll 12 having a roll surface with a plurality of projections 16 thereon as shown in the FIGURE.

The anvil roll 14 is constructed, at least in part, from a material that is relatively more elastic than the material from which scribing roll 12 is constructed. Anvil roll 14 may be entirely constructed from such elastic material, preferably, however, at least the contact surface is provided as a layer 18 of relatively more elastic material. When roll 14 is provided with a separate layer 18 of relatively elastic material, the remainder of roll 14 underlying layer 18 may be constructed of any of various materials to provide a suitable strong anvil core over which the relatively softer anvil layer 18 is placed. The anvil core may be made of metals such as steel. Preferably, at least the contact surface comprised of layer 18 is made of material having a relatively low shear modulus of elasticity. It is important that the contact surface of anvil roll 14 be resilient enough to recover its original shape as sheet 20 passes through roll set 10 between rotating rolls 12 and 14. The relatively elastic material may be natural rubber, or other materials such as silicone, neoprene, butyl rubber or plastics having similar moduli of elasticity. All would be suitable anvil surface materials. Preferably the shear modulus of elasticity of such materials is about 500 pounds per square inch (psi) or less and may range from about 2 to $5\times10^2$ psi. The modulus of elasticity is a measure of the amount of strain experienced as a function of the stress applied.

Scribing roll 12 has a roll surface with a plurality of projections 16 thereon in a spaced-apart relation. The scribing roll 12 may be constructed of a relatively inelastic material which is strong and hard and durable enough to withstand the compressive contact with strip 20 as it passes through roll set 10. Preferably, at least the projections 16 on roll 12 are constructed of such material, such as steel. The projections 16 are spaced apart on the roll surface of scribing roll 12 and are adapted to impose a compressive deformation on the surface of steel strip 20. Projections 16 are generally transverse to the rolling direction and preferably are substantially perpendicular thereto. As shown in the FIGURE, projections 16 are arranged on the roll surface in a direction substantially parallel to the axes of rolls 12 and 14. Projections 16 may be of any of various shapes; however, it is preferred that projections 16 be generally triangular in cross section as shown in the FIGURE in order to narrowly define the area of compressive force or stress applied to the surface of strip 20.

As shown in the FIGURE, projections 16 are spaced apart near the peaks a distance "a" which may be on the order of 2 to 10 mm in order to impose a compressive force or stress to the steel surface at intervals of about 2 to 10 mm. The width "b" of each projection as measured between the valleys defining a projection may be on the order of 2 to 10 mm. The depth "c" of the projections may be on the order of 0.5 to 10 mm. The particular dimensions of spacing of the scribing projections is important to achieving the desired magnetic improvement in the steel; however, it can be readily determined in the practice of the present invention. None of these dimensions of the projections are critical to the present invention.

The roll set 10 comprised of anvil roll 14 and scribing roll 12 may be generally freely-rotatable rolls which are caused to rotate about their axes by the movement of strip 20 passing therebetween. It is preferred that the rolls be rotated at a tangential velocity essentially equal to the velocity of the strip 20 passing through roll set 10.

As a specific example, a 0.26 mm final gauge and final texture annealed regular oriented silicon steel with $B_8>1.84$ and core loss of 0.747 WPP at 1.7 Tesla, at 60 Hertz was used to demonstrate the advantage of an anvil roll made of a relatively elastic material of relatively low modulus of elasticity. The scribing roll was made of hard steel and the anvil of rubber having a durometer hardness of 80. The steel typically has a shear modulus of elasticity of $12\times10^6$ psi.

Samples 30.5 cm long by 3 cm wide of the regular oriented silicon steel were placed between the anvil and scribing rolls and the rolls were adjusted until they just touched the subject sample. Then the subject sample was removed, and on successive samples, the scribing rolls were adjusted so that the opening between them was at various distances smaller than the thickness of the subject steel. These smaller distances are noted in the Table in the column headed Roll Gap Setting. A comparison set of samples was processed using an anvil of hard steel. The scribing roll had substantially triangular projections machined into a steel roll spaced at intervals of about 6 mm and accordingly were about 6 mm wide. The projections were about 4.8 mm deep. The steel was scribed to a depth of less than about $6\times10^{-3}$ mm.

TABLE

| Roll Gap Setting Relative to Steel Gauge (mils) | Change in 60 Hz Core Loss at 1.7 T (WPP) On Steel Anvil | On Rubber Anvil | Difference |
|---|---|---|---|
| Approx. −0.1 | +.004 | −.022 | −.026 |
| −1.0 | +.006 | −.008 | −.014 |
| −2.0 | +.004 | +.010 | +.006 |
| −3.0 | +.012 | −.016 | −.028 |
| −4.0 | +.027 | +.016 | −.011 |
| −5.0 | +.120 | −.001 | −.121 |
| −6.0 | +.117 | +.016 | −.101 |

In the Table, the "Change in 60 Hz Core Loss at 1.7 Tesla" is shown for the present invention and for a similar method using a steel anvil. The column entitled "Difference" indicates the decreased sensitivity to overscribing of a rubber anvil system compared to a hard anvil system. The "Difference" represents the difference in change in core loss between the steel samples scribed using a steel anvil and those scribed using a rubber anvil.

It is clear that a steel anvil generally results in damage rather than improvement in the core loss, even for the least intense scribing settings. This is believed to be because of the extreme sensitivity of the steel to the force of scribing and the extreme rigidity of a system employing a steel anvil. On the other hand, with a rubber anvil, reductions of as much as 0.022 WPP were achieved, an improvement of about 3%. The Table demonstrates that it is more difficult to impart a superficial disturbance with a steel anvil than with a rubber anvil. The softer anvil data indicates that core loss improvements can be obtained and may be optimized by adjustments in roll gap setting. The data further show that it is not practical to use an anvil roll made of hard material, such as steel, for typically in practice, the final gauge of oriented silicon steel is not perfectly uniform and because of the extremely precise control required of the pressure exerted in order to avoid overscribing or underscribing. Underscribing is the case wherein little or no core loss improvement results. Overscribing is the case wherein the steel is damaged, resulting in core loss degradation. The final gauge may vary 0.0076 mm, for example, over the length and/or width of the steel sheet. It has been found that a more elastic material allows the steel to pass through a scribing roll set with significantly less possibility of overscribing the steel.

By the use of a scribing roll and an anvil roll in accordance with the invention and specifically with the anvil roll being constructed from rubber and the scribing roll being constructed from steel, variations in the gauge of the flat-rolled steel product passing between the rolls will not significantly affect the depth of the scribes imparted to the steel. In this manner, uniform scribing may be obtained without varying the spacing between the rolls as the final gauge of the cold-rolled product passing therebetween may vary. As the speed at which the rolls may be rotated is not limited, the method of the invention may be used in line with any conventional processing equipment used in the production of grain-oriented silicon steel. In accordance with the examples herein, the scribing operation may be performed after final high temperature texture annealing at the exit end of a continuous operation, such as a heat-flattening and coating line. It is contemplated that the present invention is also useful for scribing the cold-rolled final gauge steel which has been decarburized but prior to final texture annealing. The roll set could be positioned in the continuous processing line after the decarburization annealing furnace. Furthermore, the extent or depth of scribing may be controlled as desired, depending upon when the scribing operation is performed in the continuous processing line and if the final texture annealed product will be stress relief annealed during subsequent fabrication.

The present invention does not appear to be limited to a particular type of grain-oriented silicon steel, although the invention will achieve the most benefits on high permeability steels having a permeability at 10 Oersteds of more than 1840 and large grains of greater than 3.0 mm as well as on thin gauge regular oriented silicon steel of about 0.23 mm or less.

Although several embodiments of the present invention have been shown and described, it will be apparent to those skilled in the art that modifications may be made therein without departing from the scope of the invention.

What is claimed is:

1. An apparatus for improving core loss of grain-oriented silicon steel comprising:

a freely-rotatable roll set through which cold-rolled final gauge silicon steel sheet product is passed for scribing substantially transverse to the rolling direction; the roll set including an anvil roll and a scribing roll;

the scribing roll having a roll surface which includes a plurality of projections thereon in a direction substantially parallel to the axis of the roll, the scribing roll being constructed of metal, the projections being spaced apart from 2 to 10 mm;

the anvil roll having a roll surface for contacting the steel sheet opposite the side being scribed, the surface being constructed from a material that is relatively more elastic than the metal material of the scribing roll, the anvil roll material having a shear modulus of elasticity of 2 to $5\times10^2$ psi, said rolls being spaced apart at a distance smaller than the steel thickness to effectively scribe the steel to a depth of less than about $6\times10^{-3}$ mm thereby inducing localized strains in the steel surface without overscribing the steel.

2. The apparatus of claim 1 wherein the roll surface of the anvil roll is constructed of material selected from the group of rubber, butyl rubber, silicone, neoprene and plastics.

* * * * *